US008899555B2

(12) United States Patent
Sherstad

(10) Patent No.: US 8,899,555 B2
(45) Date of Patent: Dec. 2, 2014

(54) ADJUSTABLE PICKET FENCE

(75) Inventor: Matthew Carlyle Sherstad, Dallas, TX (US)

(73) Assignee: Fortress Iron, LP, Richardson, TX (US)

( * ) Notice: Subject to any disclaimer, the term of this patent is extended or adjusted under 35 U.S.C. 154(b) by 1524 days.

(21) Appl. No.: 12/204,607

(22) Filed: Sep. 4, 2008

(65) Prior Publication Data

US 2009/0065755 A1 Mar. 12, 2009

Related U.S. Application Data

(60) Provisional application No. 60/970,473, filed on Sep. 6, 2007.

(51) Int. Cl.
*E04H 17/00* (2006.01)
*E04H 17/14* (2006.01)
*E01F 13/02* (2006.01)

(52) U.S. Cl.
CPC ..... *E04H 17/1439* (2013.01); *E01F 13/022* (2013.01); *E04H 2017/1491* (2013.01)
USPC ..... 256/65.01

(58) Field of Classification Search
USPC ..... 256/22, 34, 59–60, 65, 67, 73
See application file for complete search history.

(56) References Cited

U.S. PATENT DOCUMENTS

| | | | |
|---|---|---|---|
| 9,420 | A | 11/1852 | Hess |
| 2,218,953 | A | 10/1940 | Gustafson |
| 2,563,530 | A | 8/1951 | Hawkins |
| 2,655,345 | A | 10/1953 | Lindman |
| 2,715,513 | A | 8/1955 | Kools |

(Continued)

FOREIGN PATENT DOCUMENTS

| | | |
|---|---|---|
| JP | 10-205178 | 8/1998 |
| KR | 20-0132118 | 9/1998 |
| KR | 20-0400470 | 10/2005 |

OTHER PUBLICATIONS

Written Opinion of the International Searching Authority; International Application No. PCT/US2008/075486; Mar. 24, 2009.

(Continued)

*Primary Examiner* — Michael P Ferguson
*Assistant Examiner* — Daniel Wiley
(74) *Attorney, Agent, or Firm* — Gardere Wynne Sewell LLP; Andre M. Szuwalski

(57) ABSTRACT

A barrier is formed from at least one elongate rail and at least one vertical upright member. The elongate rail includes a web and a pair of opposed side walls which extend from the web to define a rail channel. Each upright member includes an aperture formed therein. In one implementation, a pin extending from a clip is inserted into the aperture, and the upright member, with the clip, is at least partially situated within the rail channel, wherein the clip is welded to an inside surface of the rail channel. In another implementation, a pin is inserted through the aperture, and the upright member, with the pin, is at least partially situated within the rail channel, wherein opposed ends of the pin are welded to an inside surface of the opposed side walls of the rail channel. The pin and aperture form a pivot point allowing the upright member to rotate with respect to the elongate rail. In a fence implementation, this allows the barrier to be racked in order to follow undulating terrain.

13 Claims, 18 Drawing Sheets

(56) References Cited

U.S. PATENT DOCUMENTS

| | | | | | |
|---|---|---|---|---|---|
| 3,033,532 | A | | 5/1962 | McFall | |
| 3,067,985 | A | * | 12/1962 | Cusack | 256/22 |
| 3,136,530 | A | | 6/1964 | Case | |
| 3,174,727 | A | | 3/1965 | Burt et al. | |
| 3,202,401 | A | | 8/1965 | Bastia | |
| 3,707,276 | A | * | 12/1972 | Francis et al. | 256/22 |
| 3,960,367 | A | | 6/1976 | Rogers | |
| 4,403,767 | A | * | 9/1983 | Basey | 256/66 |
| 4,690,440 | A | | 9/1987 | Rogers | |
| 4,723,760 | A | | 2/1988 | O'Sullivan | |
| 4,871,203 | A | | 10/1989 | Rogers | |
| 4,932,693 | A | | 6/1990 | Schwartz | |
| 5,136,813 | A | | 8/1992 | Gibbs et al. | |
| 5,167,049 | A | | 12/1992 | Gibbs | |
| 5,272,838 | A | | 12/1993 | Gibbs | |
| 5,345,723 | A | | 9/1994 | Gibbs | |
| 5,443,244 | A | | 8/1995 | Gibbs | |
| 5,639,178 | A | | 6/1997 | Wilson et al. | |
| 5,649,688 | A | * | 7/1997 | Baker | 256/21 |
| 5,873,564 | A | * | 2/1999 | Bisch | 256/65.12 |
| 5,913,508 | A | * | 6/1999 | Eades | 256/65.06 |
| 6,142,451 | A | | 11/2000 | Lindsey et al. | |
| 6,173,945 | B1 | | 1/2001 | Lindsey et al. | |
| 6,176,043 | B1 | | 1/2001 | Gibbs | |
| 6,254,064 | B1 | | 7/2001 | Gibbs | |
| 6,299,143 | B1 | | 10/2001 | Valentine | |
| 6,341,764 | B1 | * | 1/2002 | Conner | 256/65.12 |
| 6,530,561 | B2 | | 3/2003 | Larsen et al. | |
| 6,568,658 | B2 | * | 5/2003 | Strome | 256/65.14 |
| D479,612 | S | | 9/2003 | Larsen et al. | |
| 6,631,887 | B1 | | 10/2003 | Walmsley et al. | |
| 6,648,304 | B1 | | 11/2003 | Zhu | |
| D489,136 | S | | 4/2004 | Schwartz et al. | |
| 6,739,583 | B2 | | 5/2004 | Ryon | |
| 6,752,385 | B2 | * | 6/2004 | Zen et al. | 256/65.01 |
| 6,811,145 | B2 | | 11/2004 | Gibbs et al. | |
| 6,824,123 | B2 | | 11/2004 | Larsen et al. | |
| 7,032,890 | B2 | | 4/2006 | Svalbe | |
| 7,071,439 | B2 | | 7/2006 | Gibbs et al. | |
| 7,086,642 | B1 | | 8/2006 | O'Brien | |
| 7,100,904 | B2 | | 9/2006 | Kim | |
| 7,396,002 | B1 | * | 7/2008 | Gibbs | 256/67 |
| 2005/0071983 | A1 | | 4/2005 | Larsen et al. | |
| 2005/0092978 | A1 | * | 5/2005 | Gibbs et al. | 256/59 |
| 2005/0098771 | A1 | | 5/2005 | DeMaere | |
| 2005/0199864 | A1 | * | 9/2005 | Gibbs et al. | 256/22 |
| 2005/0205854 | A1 | | 9/2005 | Gibbs et al. | |
| 2006/0169965 | A1 | | 8/2006 | Paskar | |
| 2007/0278467 | A1 | | 12/2007 | Ash | |
| 2008/0111119 | A1 | | 5/2008 | Platt | |

OTHER PUBLICATIONS

International Search Report; International Application No. PCT/US2008/075486; Mar. 24, 2009.

Notification of Transmittal of the International Search Report and the Written Opinion of the International Searching Authority, or the Declaration; International Application No. PCT/US2008/075486; Mar. 24, 2009.

Notification Concerning Transmittal of International Preliminary Report on Patentability, International Application No. PCT/US2008/075486, Mar. 9, 2010.

* cited by examiner

ADJUSTABLE PICKET FENCE

PRIORITY CLAIM

The present application claims the benefit of U.S. Provisional Application for Patent 60/970473 filed Sep. 6, 2007 entitled "Barrier System", the disclosure of which is hereby incorporated by reference to the maximum extent allowable by law.

BACKGROUND OF THE INVENTION

1. Technical Field of the Invention

The present invention relates to barriers to pedestrians or vehicles, and more particularly to fences and fence components.

2. Description of Related Art

Metal fences of various kinds are well known in the art. Such metal fences are typically assembled from stock metal components making up the rails and pickets (uprights) joined together through a welding process. The assembled components form a fence panel of generally rectangular shape. Vertical posts are mounted in the ground (for example, through a cement footing or base), and a fence panel extends between, and is mounted to, a pair of vertical posts. Alternatively, two or more of the upright members in the fence panel extend below a lower-most one of the rail members. The extensions of the upright members allow for the fence panel to be installed in the ground.

It is commonplace for there to exist uneven, sloping ground topography where a fence needs to be installed. The installation of rigidly assembled metal fence panels on such topography is difficult because of the aesthetic need for the vertical parts of the fence, the posts and uprights (pickets), to be vertically oriented. This requires either the manufacture of custom fence panels designed for the pitch of the underlying ground topography, or for the vertical offsetting of adjacent fence panels along the length of the fence line to account for the sloping terrain.

There exists a need in the art for a metal fence panel having an adjustable racking capability so that the fence panel can be used in connection with fence installations on either horizontal or sloping terrain. Preferably, the needed panel with a racking capability will be economically manufacturable and easy to install.

SUMMARY OF THE INVENTION

In an embodiment, a barrier (for example, a fence panel) is formed from at least one elongate rail and at least one vertical upright member. The rail includes a flat web and a pair of opposed side walls which extend from the web to define a rail channel. The upright member includes an aperture formed there through. The upright member is at least partially situated within the rail channel. A clip member is welded inside the rail channel. Preferably, resistance type welding is used so as to minimize (or eliminate) the presence of markings on the outer surface of the rail channel due to welding of the clip member therein. Preferably, the clip member has two opposed flanges, each flange including an extending pin, wherein the two pins are inserted in opposite ends of the aperture formed through the upright member.

In another embodiment, a barrier (for example, a fence panel) is formed from at least one elongate rail and at least one vertical upright member. The rail includes a flat web and a pair of opposed side walls which extend from the web to define a rail channel. The upright member includes a hole formed there through. A pin is inserted through the hole. The upright member, with the pin, is at least partially situated within the rail channel. Opposed ends of the pin are welded to an inside surface of the opposed side walls of the rail channel. Preferably, resistance type welding is used so as to minimize (or eliminate) the presence of markings on the outer surface of the opposed side walls of the rail channel.

In either embodiment, the pin and hole form a pivot which supports movement of the at least one vertical upright member relative to the at least one elongate rail. This enables the barrier to be racked for use in stair or undulating terrain installation. The barrier is further used, when not racked, in flat terrain installations.

In another embodiment, a fence panel comprises an elongate rail defining a channel, an upright picket including an aperture extending therethrough, a pivot pin extending into the aperture, and means for mounting the pivot pin within the channel of the elongate rail. The means may comprise a clip member having a pair of opposing flanges each supporting one pivot pin for insertion into, and at opposite ends of, the aperture, wherein the clip member is securely mounted to an inner surface of the channel for the elongate rail. The means may alternatively comprise a projection weld formed between each end of the pivot pin (extending through the aperture) and an inner surface of the channel for the elongate rail.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1:
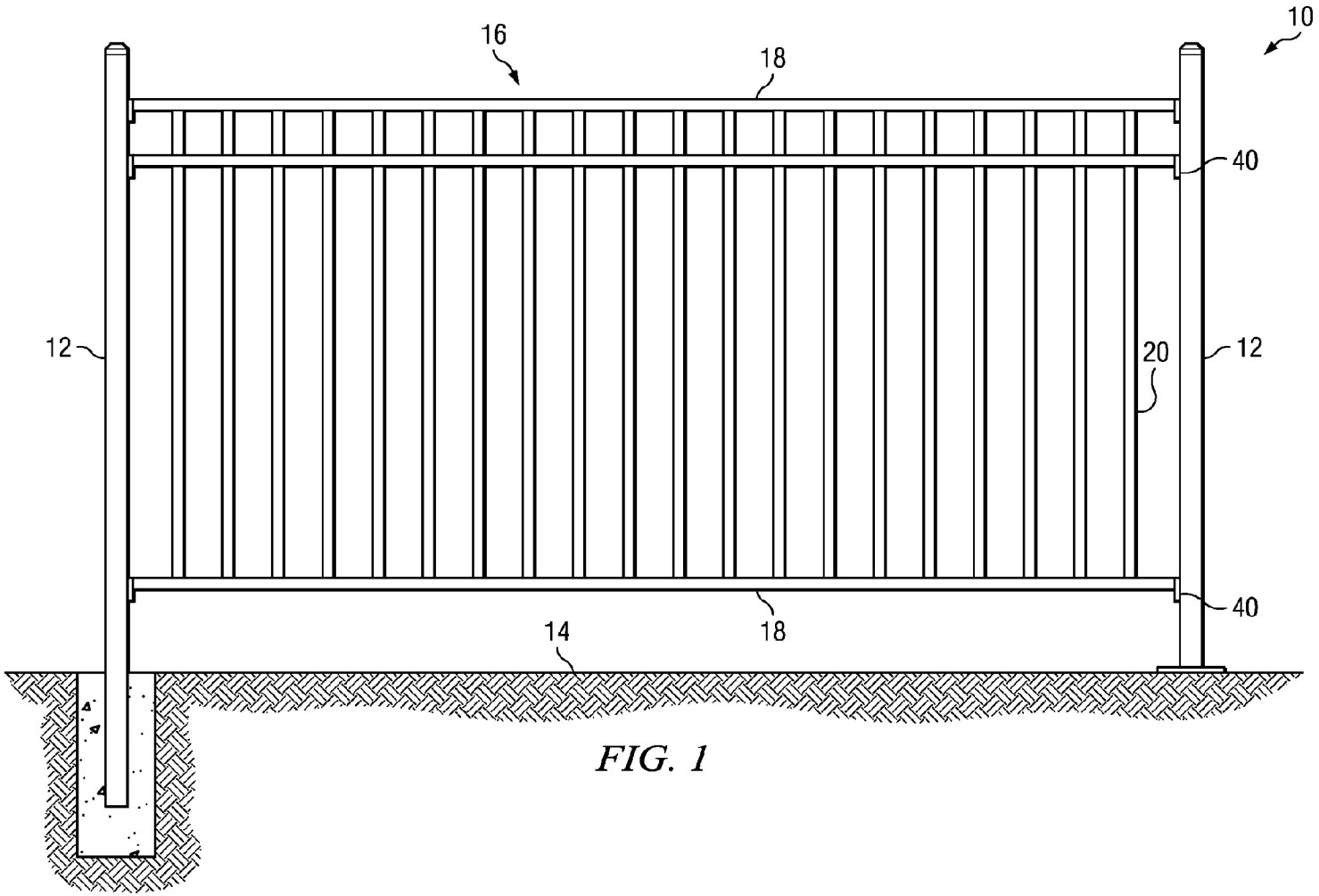
FIG. 1 shows a barrier system as embodied for example in a fence on flat terrain.

Embodiments disclosed herein relate to a barrier system, such as a fence, fence panel, balustrade, or gate, formed from at least one, and preferably a plurality of, elongate rails, and at least one, and preferably a plurality of, upright members. FIG. 1 shows the barrier system as embodied for example in a fence, generally designated by reference numeral 10.

The fence 10 preferably comprises a plurality of spaced vertical posts 12, preferably identical in construction, each of which is securely anchored at its base into a substrate 14, such as the ground, or an underground mass of concrete. The posts 12 are situated along the boundary of the area to be enclosed by the fence 10, with a post spacing which is adequate to impart strength to the fence 10 and to securely anchor other fence components. In the FIG. 1 embodiment, a post separation distance of 6-12 feet would be typical.

Each post 12 is preferably formed from a strong and durable material, such as sheet steel or aluminum. In order to enhance its resistance to corrosion, the sheet may be subjected to a galvanizing treatment. The sheet is typically subjected to a cold rolling process to form the post into a tubular configuration, preferably having a square/rectangular cross-section. Alternately, the post may be formed with a circular cross-section. Still further, the post may be made of wood, composite or vinyl materials. If desired, a polyester powder coating, painting or other suitable surface treatment may be applied to the post 12 (for example, in order to further enhance corrosion resistance).

With continued reference to FIG. 1, the fence 10 may be formed from a plurality of panels 16, each of which is supported by, and extends between, an adjacent pair of posts 12 (wherein posts may be shared by two or more panels if necessary). Each panel 16 is formed from at least one rail 18, and at least one upright member 20. More preferably, each panel 16 is formed from a plurality of spaced and parallel rails 18, and a plurality of spaced and parallel upright members 20, such as the pickets shown in FIG. 1. As shown in FIG. 1, the upright members 20 forming each panel 16 extend in substantially perpendicular relationship to the rails 18 forming that panel. In an alternate implementation shown in FIG. 2, the upright members 20 forming each panel 16 do not extend perpendicularly to the rails 18 forming that panel, thus allowing the panel to be used in connection with undulating terrain (or stairs). The angle between the rails and upright members is adjustable (at the installation site), as will be described in more detail below, in order to accommodate panel installation over a variety of terrain features. The panel 16 is thus constructed to support both the FIG. 1 installation with perpendicular rails/pickets, and the FIG. 2 installation with non-perpendicular rails/pickets. If desired, a polyester powder coating, painting or other suitable surface treatment may be applied to the panel 16 (for example, in order to further enhance corrosion resistance).

Figure 2:
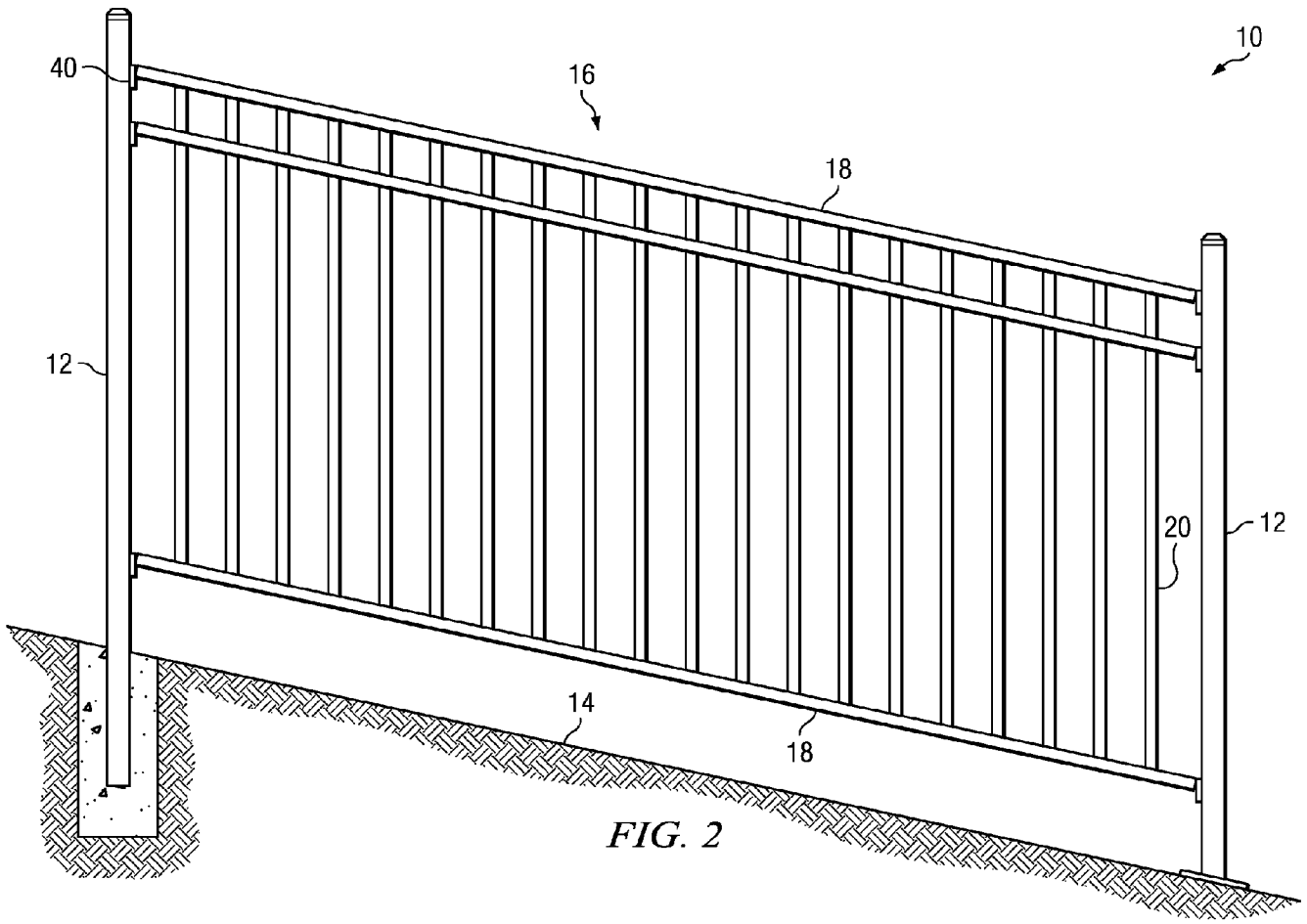
FIG. 2 shows a barrier system as embodied for example in a fence on sloping terrain.

While any number of rails may be provided for each panel 16, FIGS. 1 and 2 show the use of three rails per panel. A configuration with two rails per panel may alternatively be used. Still further, a configuration with four rails per panel may alternatively be used. The number of upright members 20 provided for each panel 16 should be sufficiently great to assure that the separation distance between adjacent upright members 20, or between a post 12 and an adjacent upright member 20, will not permit passage therebetween. A separation distance of 2-8 inches is normal.

Figure 3A:
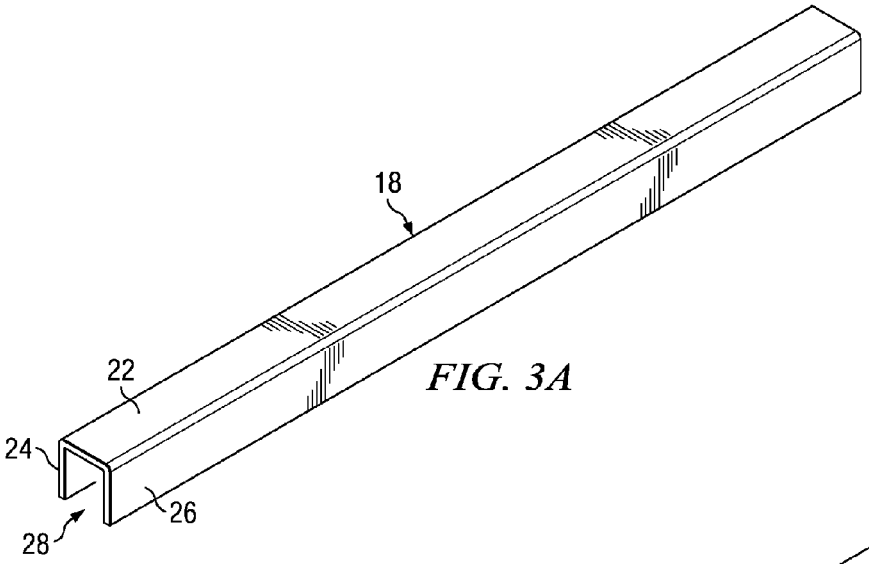
FIGS. 3A-3C show two rails and a clip associated with an implementation allowing for a fence panel to be racked to follow undulating terrain.
Figure 3B:
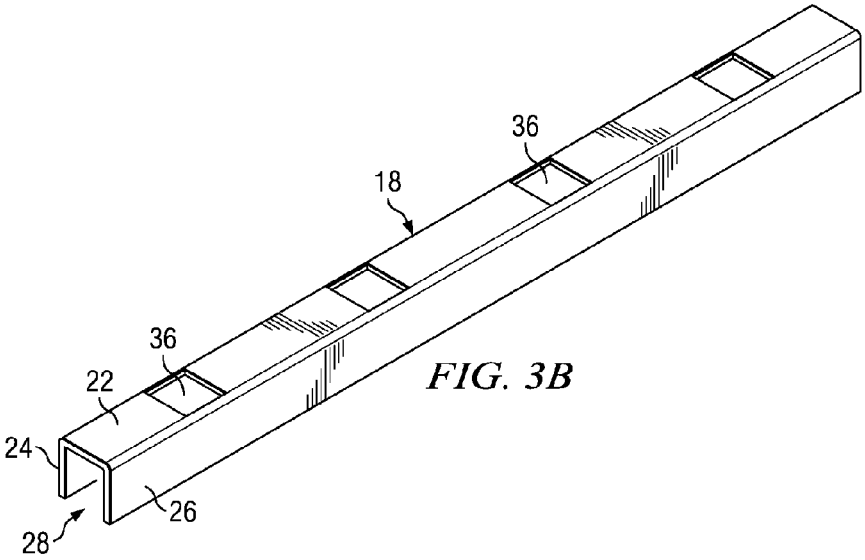
Figure 3C:
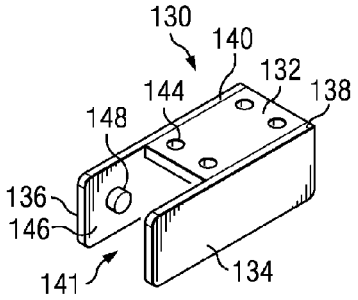

In connection with an implementation which facilitates racking of the panel for installation on undulating terrain, reference is made to FIGS. 3A and 3B which show rail members 18 used in the panel 16, and further to FIG. 3C which show an upright connection clip used within the rail members 18 in a manner to be described. As shown in FIGS. 3A and 3B, each rail 18 comprises an elongate flat web 22 and a pair of opposed side walls 24 and 26 which extend from the web 22. The web 22 and side walls 24 and 26 collectively define a U-shaped rail channel 28. It will be noted that the rail can be formed to include a fourth side if desired. A flat web 22 is illustrated, and is preferred in the present invention so as to accommodate and support the mounting of a clip member (to be described in more detail in connection with FIG. 3C). It will be understood that this flat web 22 is not a requirement, and the rail may alternatively include an elongate web having an arched, rounded or oval shape so long as provision is made for the mounting of the clip member within the interior of the channel 28. The length of each rail 18 should be sufficient to fully span the distance between the adjacent of pair of posts 12 which will support that rail, or support the panel 16 into which the rail will be incorporated. Each rail 18 is preferably formed from a strong, durable and conductive material, such as a sheet steel or aluminum. If desired, and in order to enhance its resistance to corrosion, the sheet may be subjected to a galvanizing treatment. The sheet is subjected to a cold rolling process to produce the cross-sectional shape shown in FIGS. 3A and 3B. FIG. 3A illustrates a rail 18 for use as a top rail of a panel 16. FIG. 3B illustrates a rail 18 for use as a top, middle or bottom rail of a panel 16.

Reference is now made to FIG. 3C which illustrates a clip member 130. The clip member 130 is formed from a base plate 132 and a pair of opposed flanges 134 and 136 which extend perpendicularly from the base plate 132 at edges 138 and 140, respectively. It will be noted that the flanges 134 and 136 are longer than the base plate 132, and include a distal end portion 141 which is not mounted to edges 138 and 140. Thus, the distal end portion 141 of each of the flanges 134 and 136 is free to be laterally flexed in a direction parallel to the surface of the base plate 132. The base plate 132 has a top surface from which a plurality of projections 144 extend. These projections 144 assist in the welding assembly process as will be described below. An inwardly facing surface 146 of each flange 134 and 136 is provided with an inwardly extending pin member 148 in the area of the distal end portion 141.

Figure 3D:
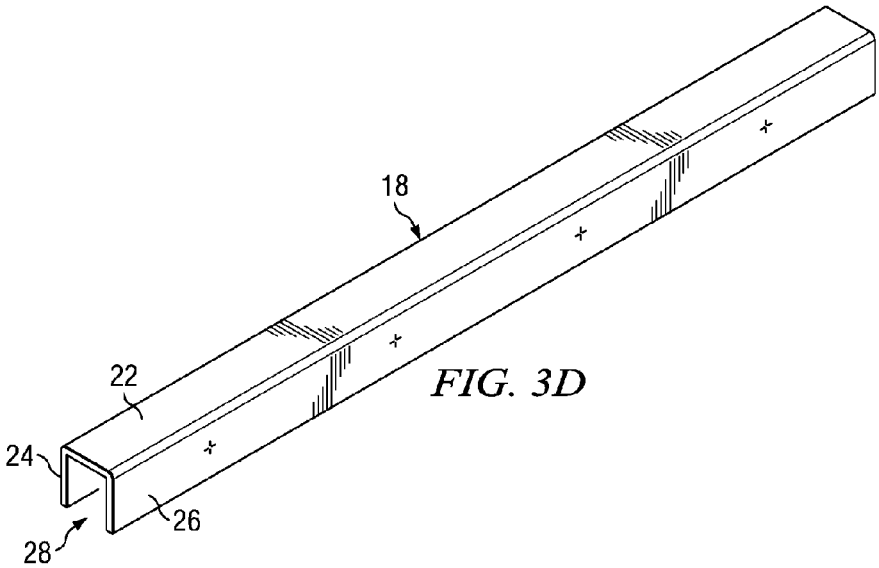
FIGS. 3D-3E show two rails associated with another implementation allowing for a fence panel to be racked to follow undulating terrain.
Figure 3E:
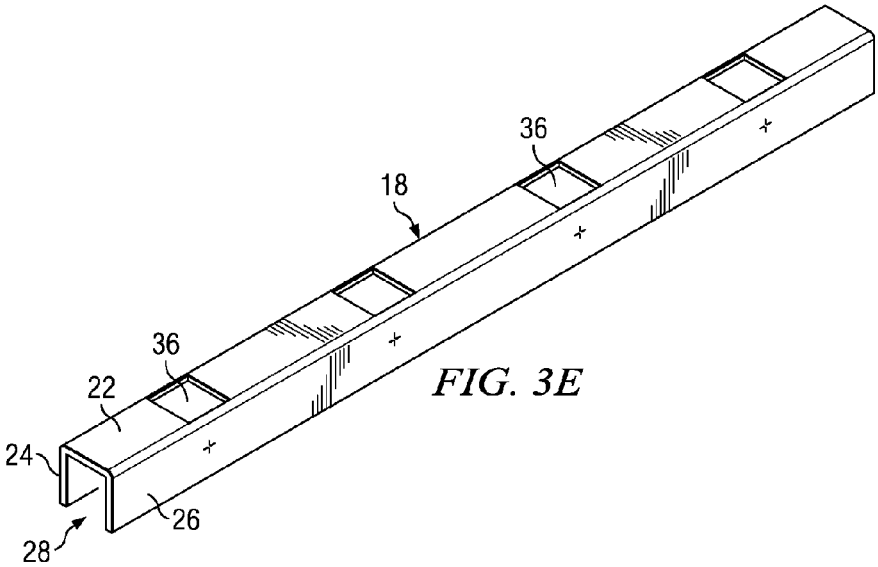

In connection with another implementation which facilitates racking of the panel for installation on undulating terrain, reference is made to FIGS. 3D and 3E, which show rail members 18 used in the panel 16. Each rail 18 comprises an elongate flat web 22 and a pair of opposed side walls 24 and 26 which extend from the web 22. The web 22 and side walls 24 and 26 collectively define a U-shaped rail channel 28. Again, a four sided rail could be used. Although a flat web 22 is illustrated, it will be understood that this is not a requirement, and the rail may alternatively include an elongate web having an arched, rounded or oval shape. The length of each rail 18 should be sufficient to fully span the distance between the adjacent of pair of posts 12 which will support that rail, or support the panel 16 into which the rail will be incorporated. Each rail 18 is preferably formed from a strong, durable and conductive material, such as a sheet steel or aluminum. If desired, and in order to enhance its resistance to corrosion, the sheet may be subjected to a galvanizing treatment. The sheet is subjected to a cold rolling process to produce the cross-sectional shape shown in FIGS. 3D and 3E. FIG. 3D illustrates a rail 18 for use as a top rail of a panel 16. FIG. 3E illustrates a rail 18 for use as a top, middle or bottom rail of a panel 16.

Figure 4A:
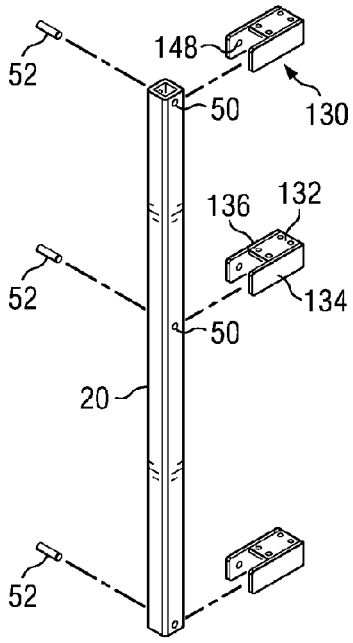
FIGS. 4A-4C show upright members for use in connection with the implementations of FIGS. 3A-3C.
Figure 4B:
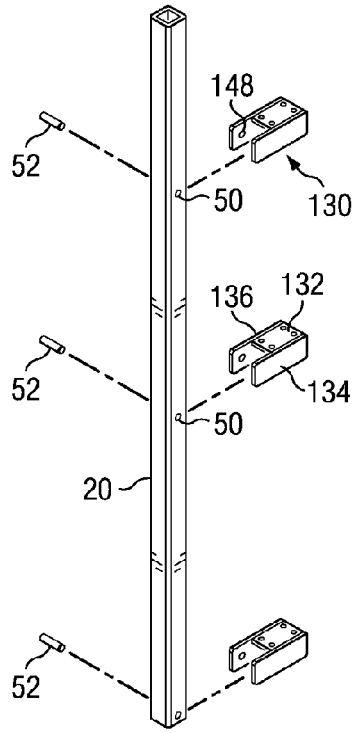
Figure 4C:
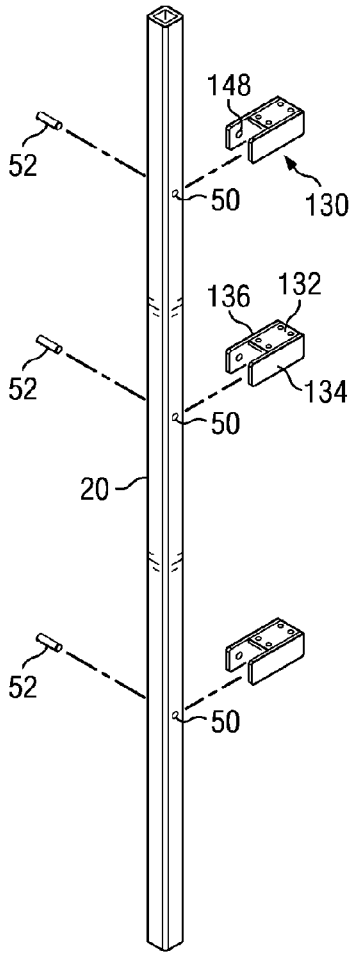

With reference now to FIGS. 4A, 4B and 4C, each upright member 20 is preferably formed from a strong, durable and conductive material, such as sheet steel or aluminum. If desired, and in order to enhance its resistance to corrosion, the sheet may be subjected to a galvanizing treatment. The sheet is then subjected to a cold rolling process to form the upright member into a tubular configuration, preferably having a rectangular cross-section (although circular and ovular cross-sections also possible). Alternatively, the upright member may be formed of solid bar stock (with any suitably selected cross-sectional shape). Each of the upright members 20 is preferably sized to be clearly received (i.e., without binding so as to prevent all movement) within the rail channel 28 of each rail 18, and further to be clearly received through any openings 36 (to be described in more detail herein) formed in the web 22 of any of the rails 18. In connection with the embodiment of FIG. 3C (as shown on the right hand side of FIGS. 4A, 4B and 4C), each of the upright members 20 is preferably sized to be clearly received (i.e., without binding so as to prevent all movement) between the pair of opposed flanges 134 and 136 of the clip member 130 to which it will be attached.

At least one aperture (or hole or dimple) 50 is formed in or through the upright member 20. The aperture 50 is sized to receive, at either end of the aperture and possibly extending therethough if desired, a pin forming a pivot point for enabling the racking of the fence panel. It will, of course be understood that the aperture 50 need not extend completely through the upright, but that instead dimples or recesses may be formed on opposite sides of the upright the pin(s) forming the pivot points. The apertures are formed with an orientation and placement to support formation of a laterally oriented pivot with respect to the rail channel as will be described in more detail.

Turning first to the implementation of FIGS. 3A-3C, the aperture 50 shown in FIGS. 4A-4C is sized to receive, at either end of the aperture 50, the opposed pin members 148 and 134 of the clip member 130 (see, FIG. 3C). In a preferred implementation, the inner diameter of the aperture 50 is just slightly larger than the outer diameter of the pin member 148 so as to allow for rotation of the pin within the hole (and without slop so as to minimize the risk of rattling). The pivot formed by aperture 50 and pin member 148 is oriented laterally with respect to the longitudinally extending rail channel length (in other words, perpendicular thereto and across its width). In one embodiment, illustrated in FIG. 15 (middle), a pin member 148 is inserted through an aperture 150 formed in the flanges 134 and 136 and optionally secured thereto (for example by welding). In another embodiment, also illustrated in FIG. 15 (bottom), the flanges 134 and 136 are subjected to a shaped punching action which deforms the flanges to form opposed integral pin members 148'. FIGS. 3A-3C more generally show opposed pin members 148 of the clip member 130 without regard to the specific manufacturing techniques used in connection with FIG. 15 (middle and bottom), and thus it will be recognized that a number of alternative manufacturing techniques may be used in connection with the fabrication of the clip member 130 to include opposed pin members 148.

Figure 5:
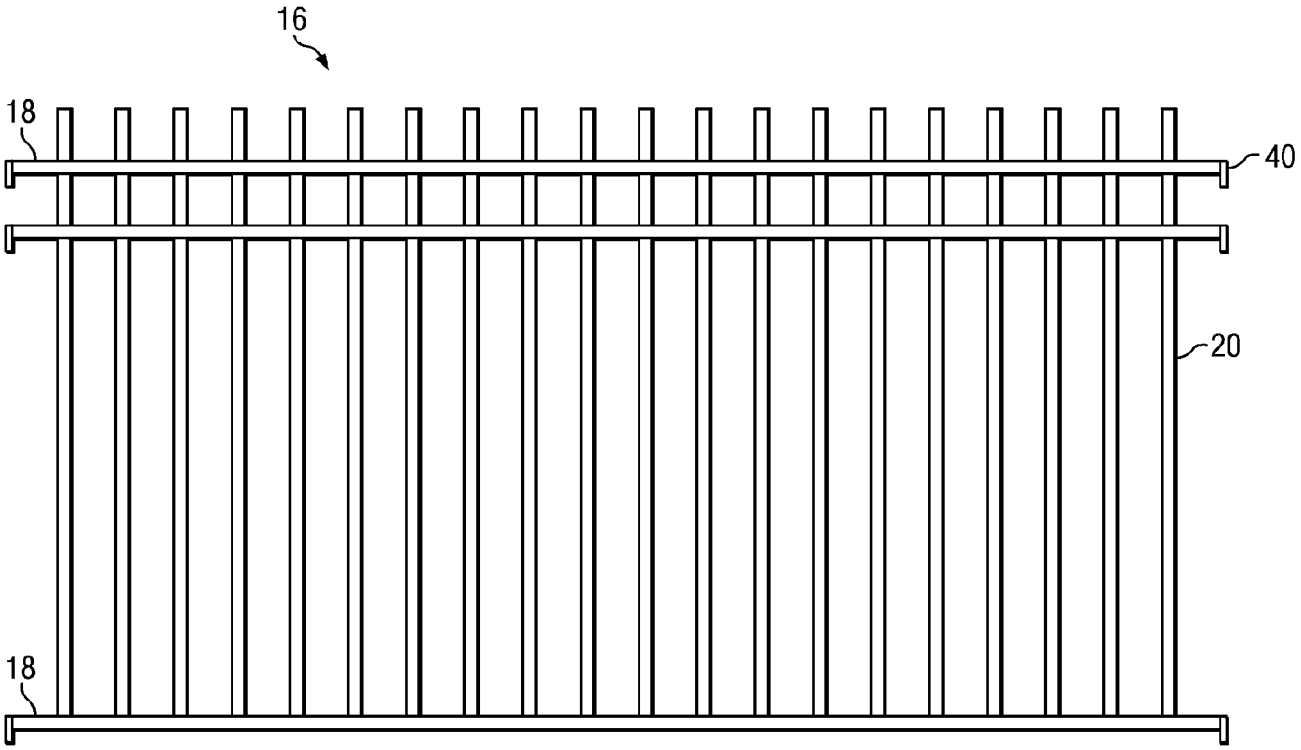
FIGS. 5-7 show use of the upright members of FIGS. 4A-4C in fence panel assemblies.
Figure 6:
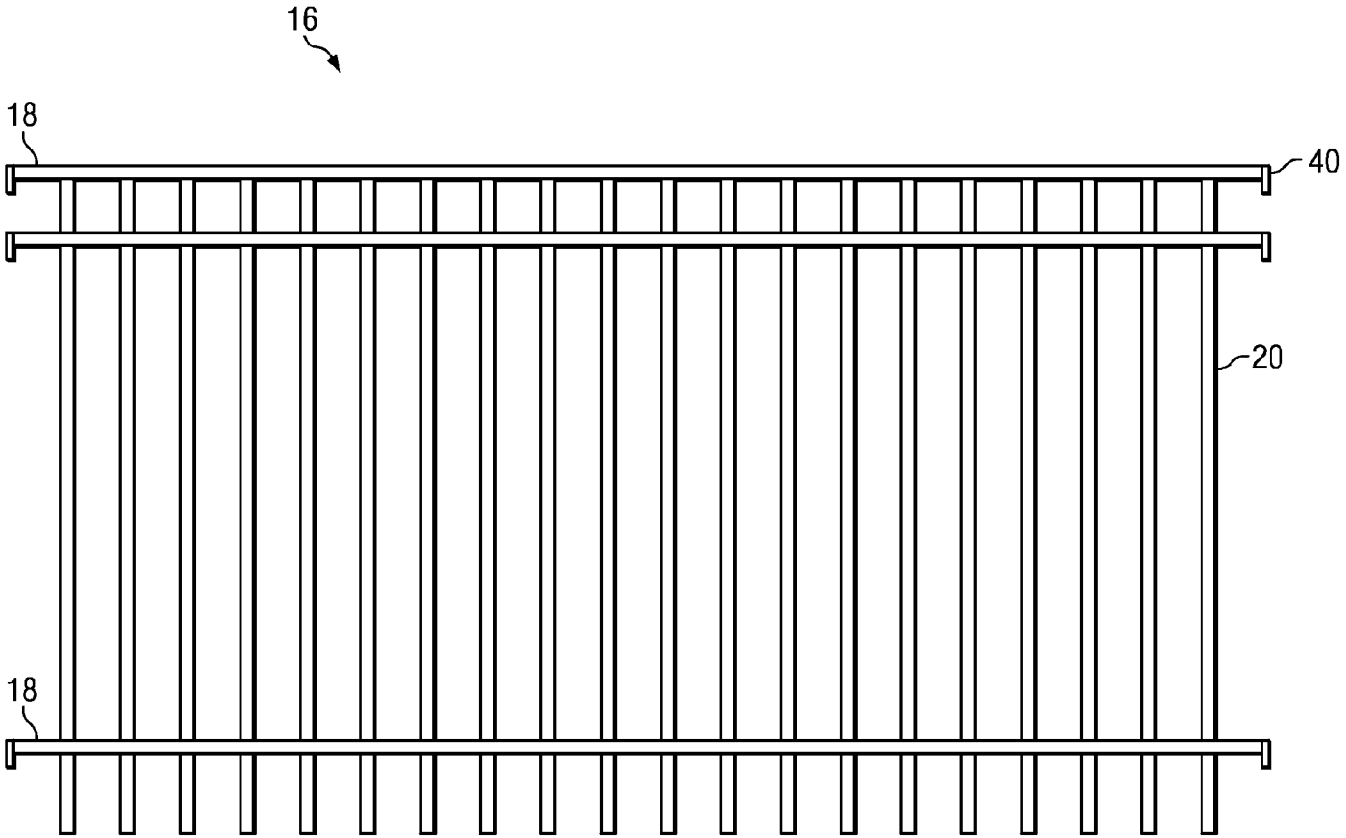
Figure 7:
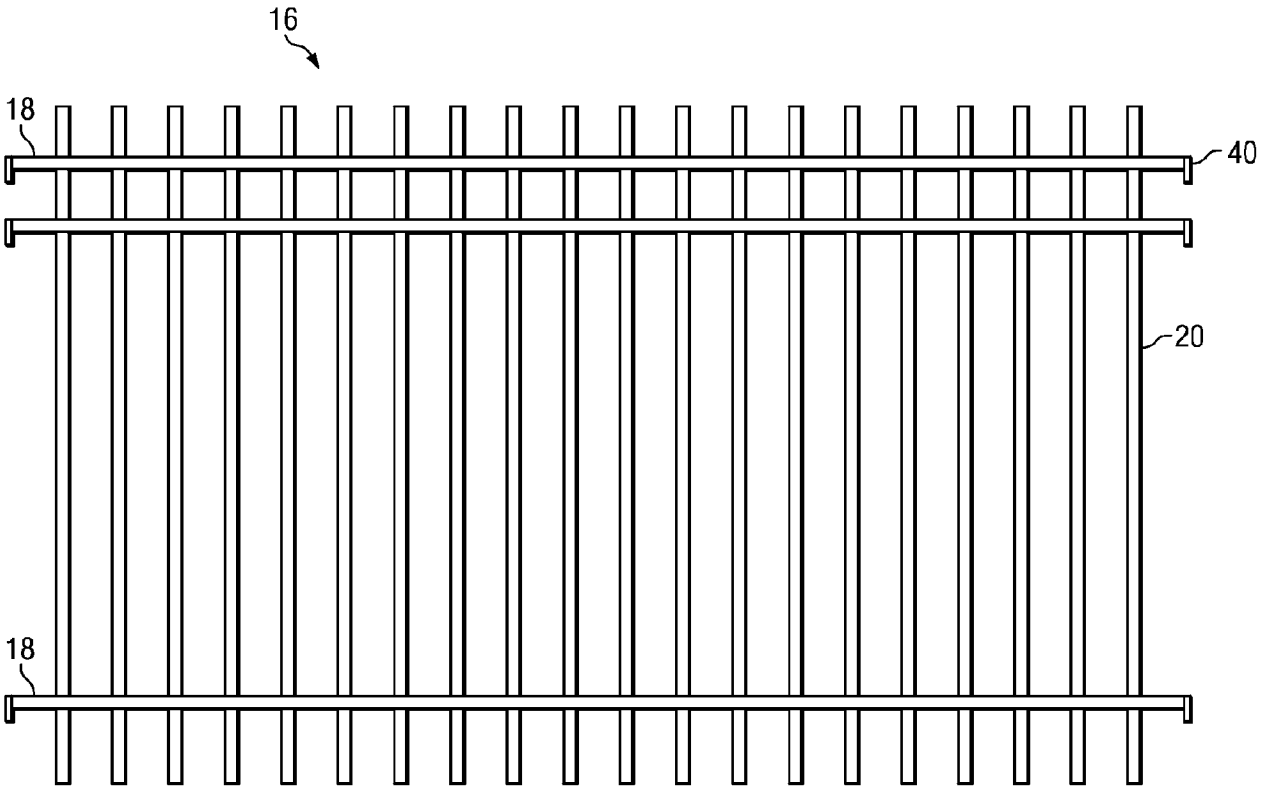
Figure 10A:
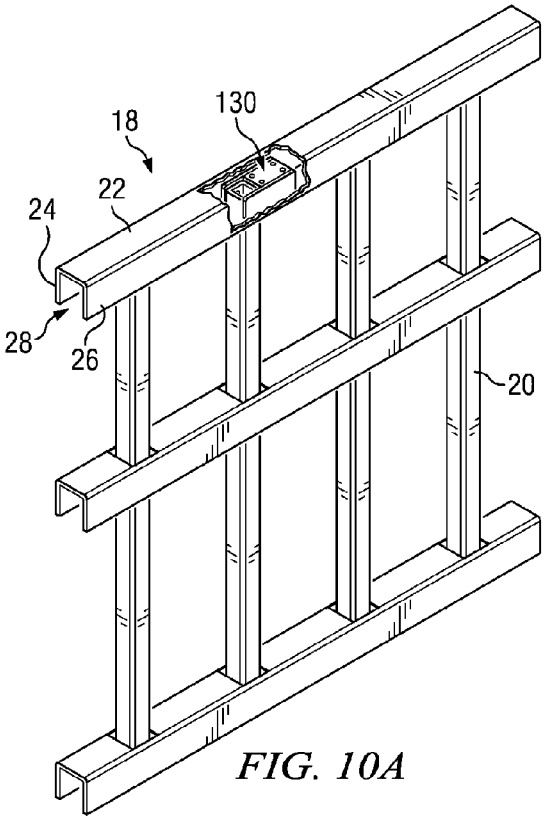
Figure 11:
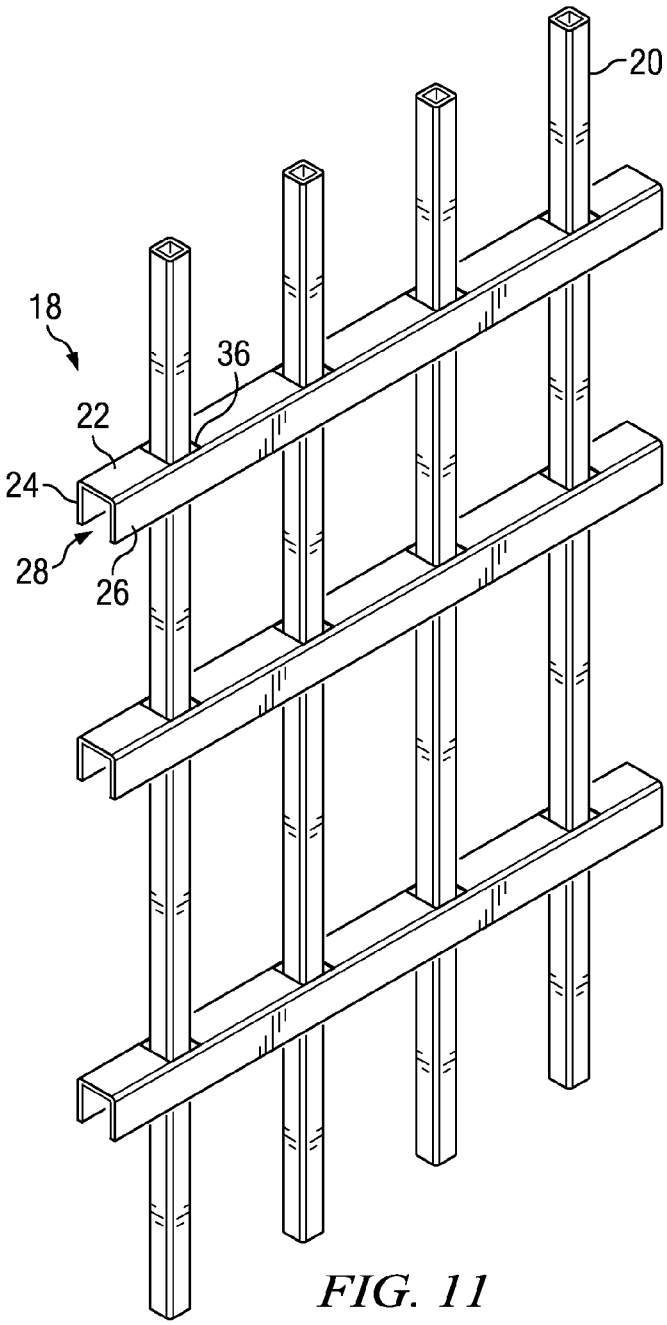
FIGS. 11-12 show fence panels.
Figure 12:
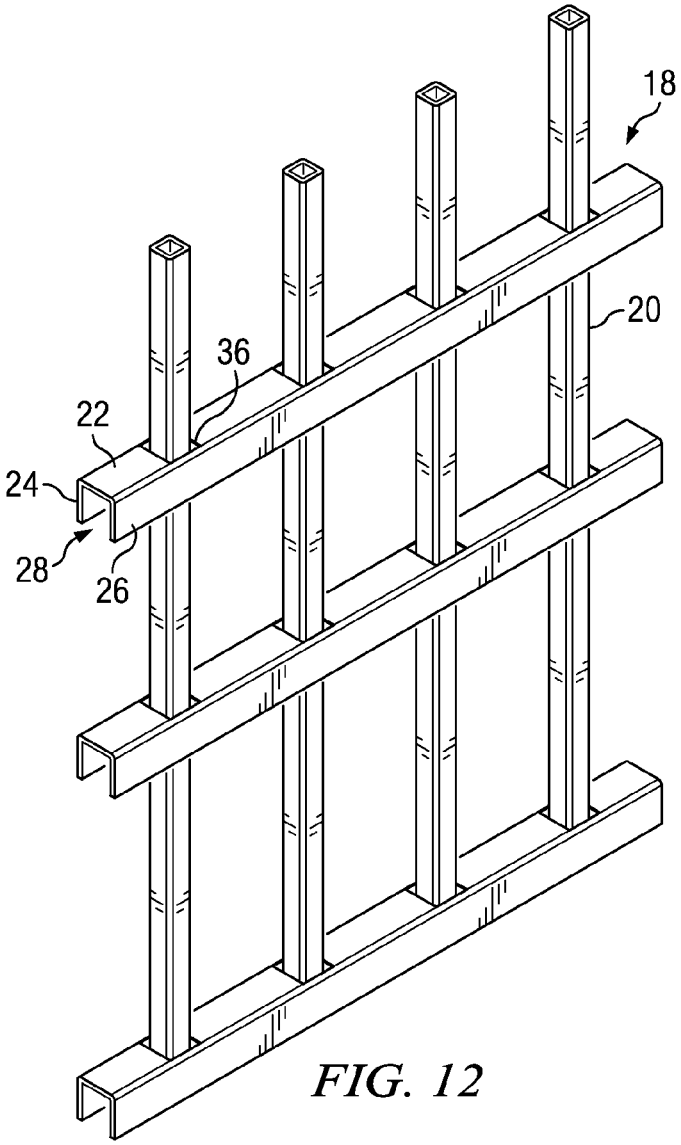
Figure 13A:
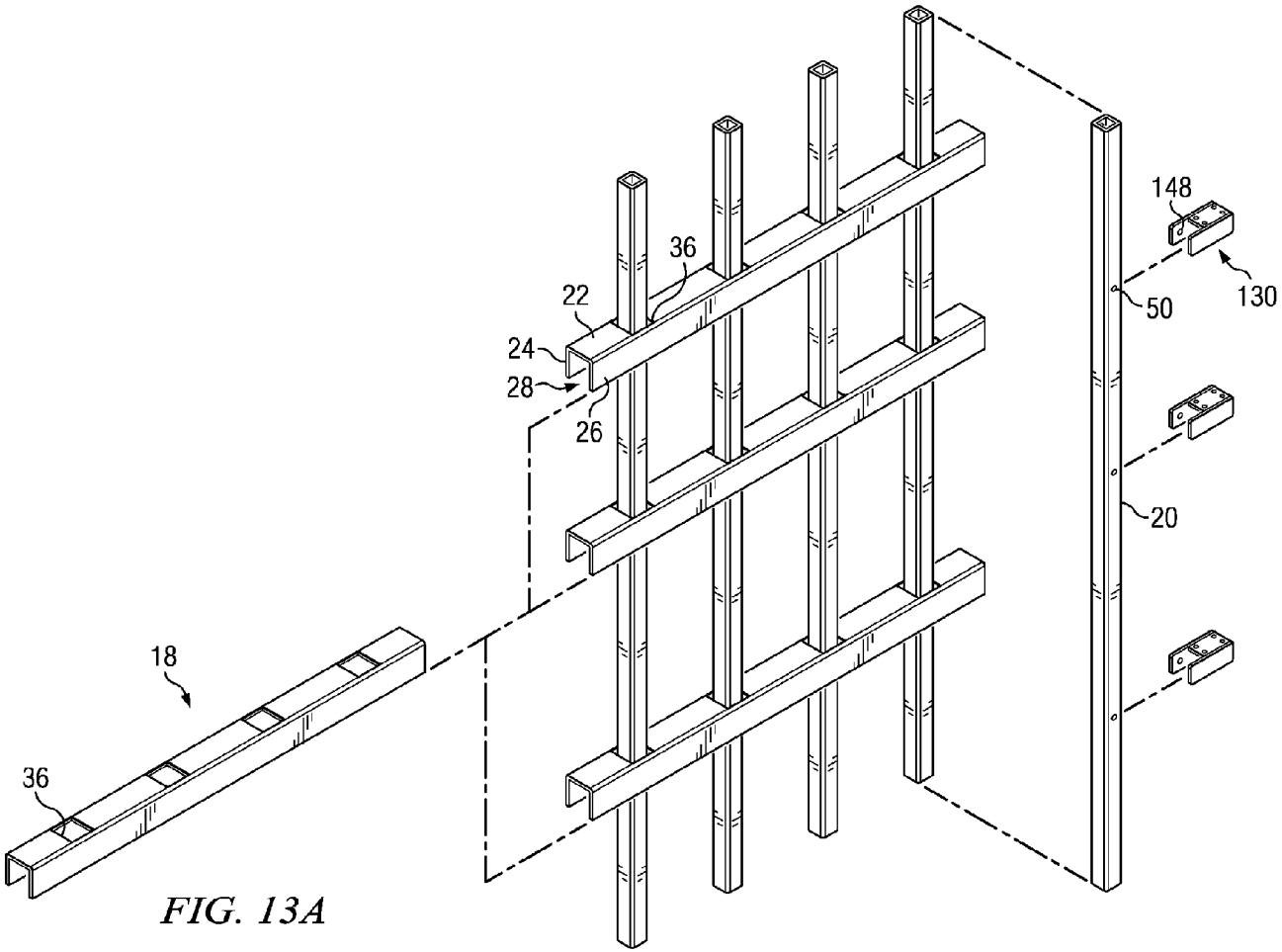
Figure 14:
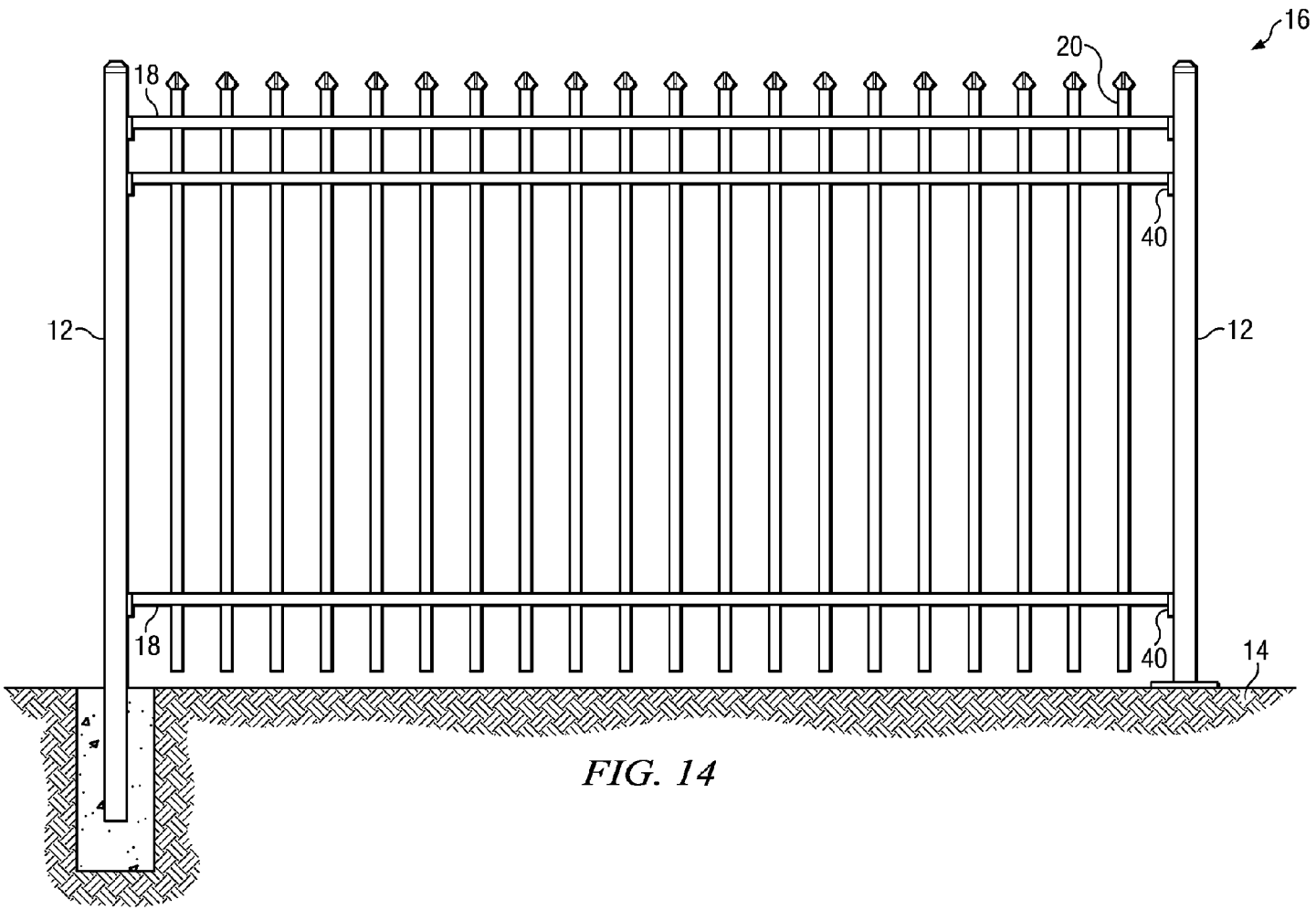
FIG. 14 shows an installed barrier system.

The location along the length of the members 20 of any included apertures 50 is selected based on the type of barrier/fence being constructed. FIG. 4A shows aperture location for use in an embodiment having a flat top and flat bottom panel as shown in FIGS. 1 and 2 (see, also, FIG. 10A). FIG. 4B shows aperture location for use in an embodiment having an extended top and flat bottom panel as shown in FIG. 5 (see, also, FIG. 12). Aperture location on the upright member 20 may further be selected (not explicitly shown) for use in an embodiment having a flat top and extended bottom panel as shown in FIG. 6. FIG. 4C shows aperture location for use in an embodiment having an extended top and extended bottom panel as shown in FIG. 7 (see, also, FIGS. 11, 13A and 14).

Figure 8A:
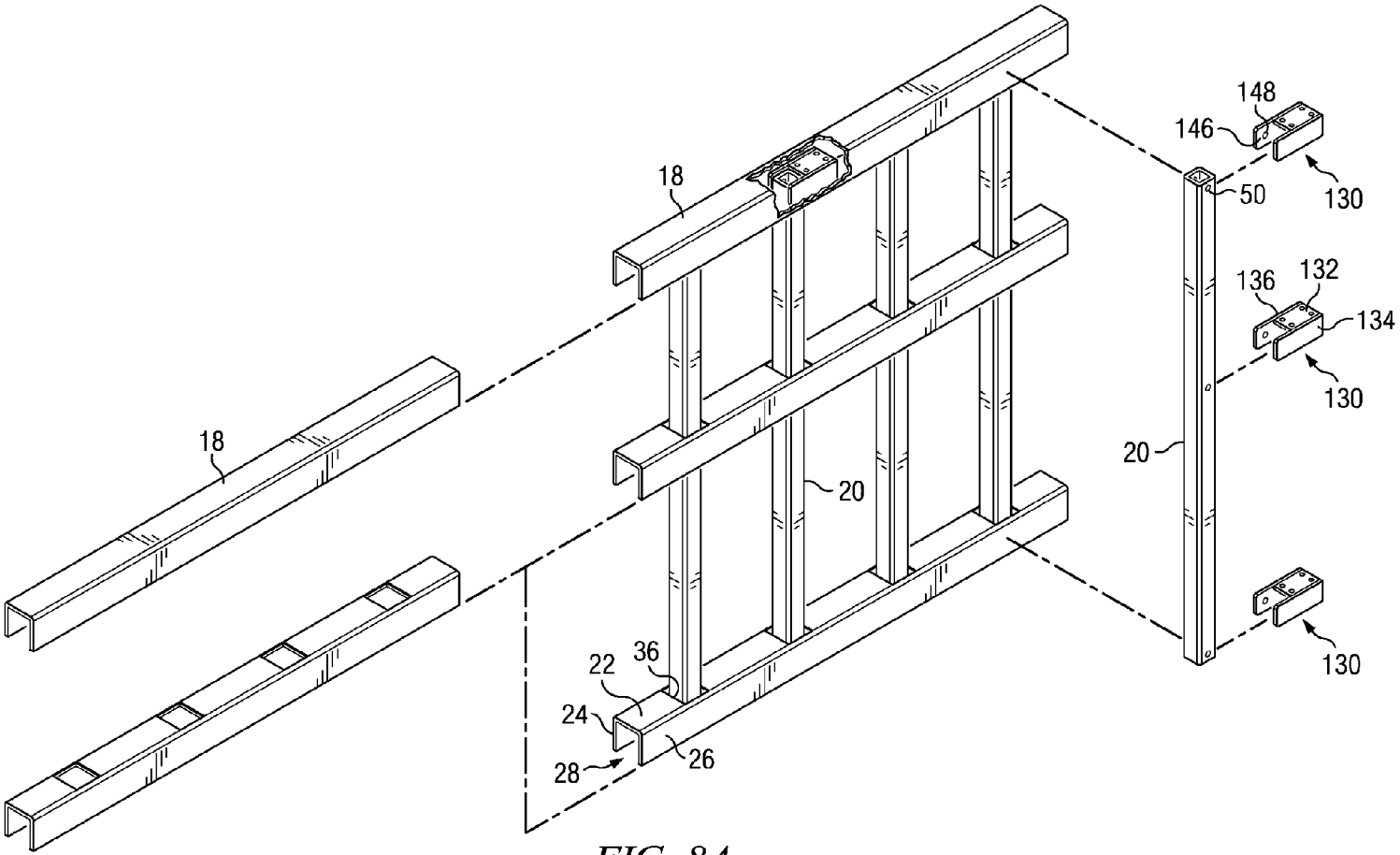
FIGS. 8A, 9A, 10A and 13A show an exemplary assembly of a fence panel in accordance with the implementation of FIGS. 3A-3C.
Figure 9A:
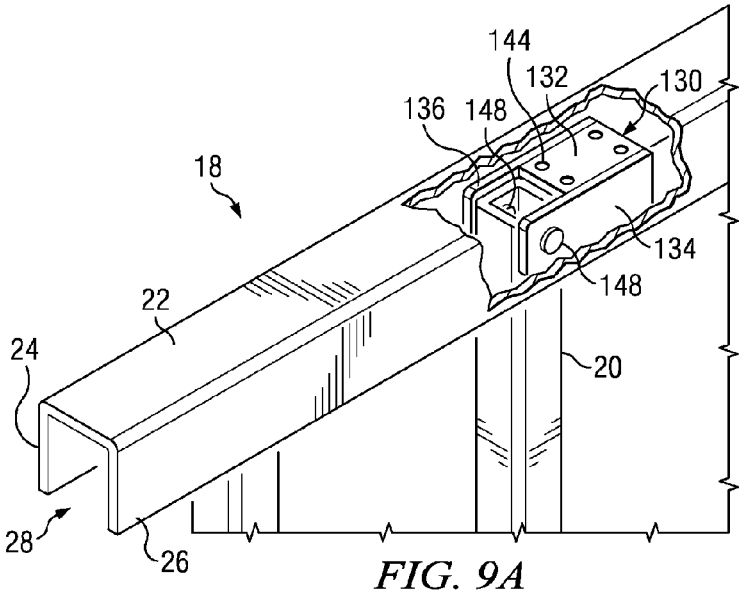

Reference is now made to FIG. 8A which shows an exemplary assembly of a panel (such as the panel used in the fence of FIGS. 1 and 2). Each panel includes three rails comprising one FIG. 3A rail and two FIG. 3B rails. The FIG. 3A rail forms a top rail of the panel, while the two FIG. 3B rails form a middle and bottom rail, respectively, of the panel. A clip member 130 is attached at each aperture 50 location on an upright member 20 (so that the inwardly extending pin members 148 from the inner surface 146 of each flange 134 and 136 engage the opposed ends of the aperture 50). With respect to the two FIG. 3B rails, the upright members pass through rectangular openings 36 formed in the web 22 at the positions in the panel where upright members are desired. It will of course be understood that the opening 36 need not in all cases be rectangular, but instead may be oval-shaped especially for use in situations where the upright members have round or oval cross-sections. The clip member 130 for each upright member is received within the rail channel 28 of each rail 18 in a proper alignment (see, FIG. 9A). It will be understood that depending on the size of the clip member 130 and openings 36 a sequential assembly operation of the rails, clips and uprights may be needed. That assembly operation is not described herein in detail since such would be understood by one skilled in the art. A projection (resistance) welding technique known to those skilled in the art is used to weld the clip members 130 to the inside of the rail. More specifically, the projection weld is formed between the projections 144 on base plate 132 and the flat web 22. It may alternatively be possible to form the weld between the opposed flanges 134 and 136 and the pair of opposed side walls 24 and 26 which extend from the web 22. No direct welding of the upright member to the rail (or clip member 130) is made. This results in the formation of a pivot, formed by the pin members 148 and holes 50, which is laterally oriented, at the intersection of each upright member to each rail which allows for rotation of the upright member to orientations which are not perpendicular to the rail. With the resistance projection welding technique, the welds used to assemble each panel 16 are formed internally within the rail channels 28. The exterior surfaces of the panel 16 accordingly do not display any of the visible blemishes and marks which are characteristic of other assembly methods, such as those involving other types of welding or fasteners.

Figure 8B:
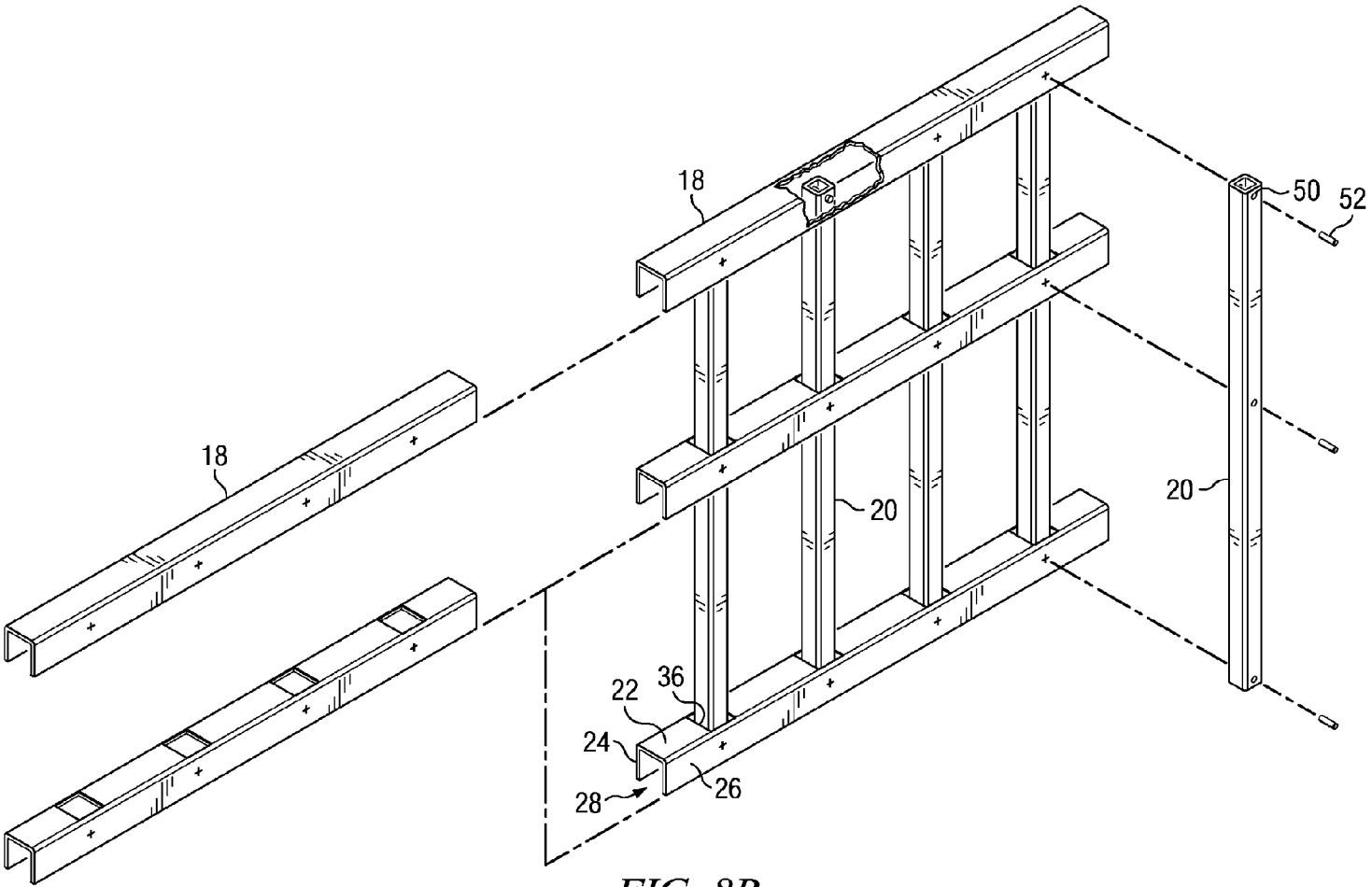
FIGS. 8B, 9B, 10B and 13B show an exemplary assembly of a fence panel in accordance with the implementation of FIGS. 3D-3E.
Figure 15:
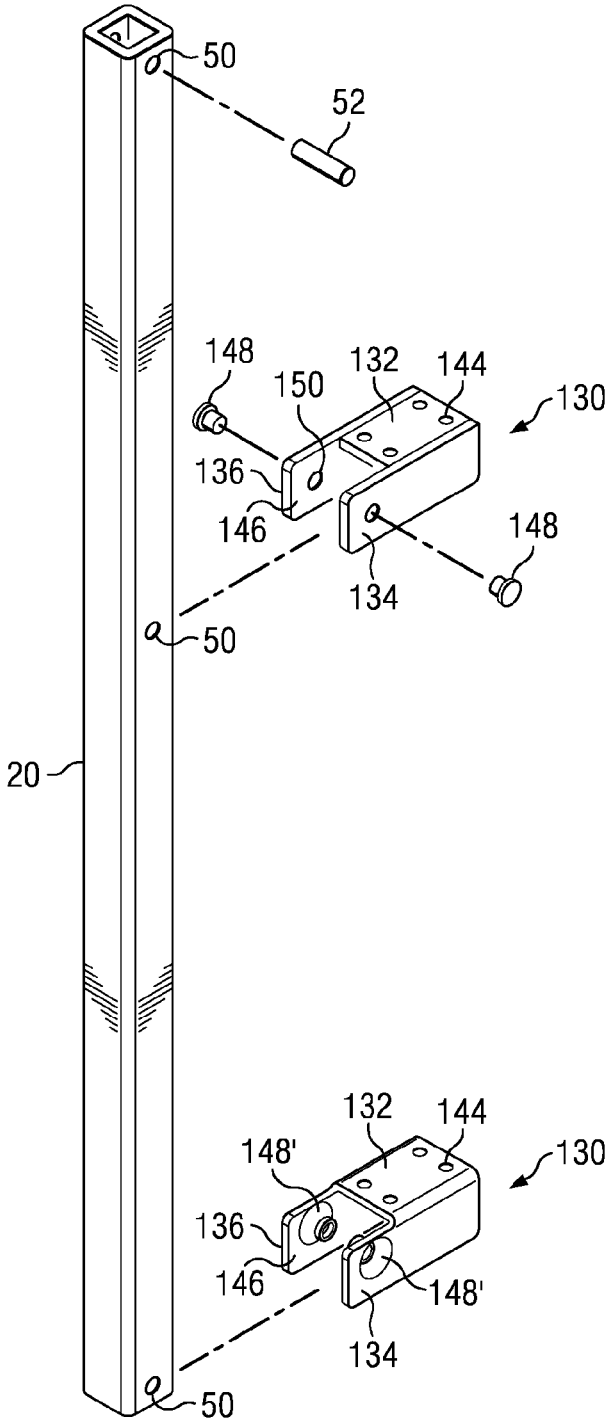
FIG. 15 illustrates on a single drawing three different embodiments for rail and picket mounting hardware allowing for a fence panel to be racked to follow undulating terrain.

Turning next to FIG. 8B and the embodiment of FIGS. 3D-3E, the aperture 50 shown in FIG. 8B is sized to receive a pivot pin 52 having a length which exceeds the width of the member 20 and is substantially equal to a distance between the pair of opposed side walls 24 and 26 which extend from the web 22 of the rail 18 (see, FIGS. 3D and 3E). In a preferred implementation, the inner diameter of the aperture 50 is just slightly larger than the outer diameter of the pin so as to allow for rotation of the pin within the hole (and without slop so as to minimize the risk of rattling). The pivot formed by aperture 50 and pin 52 is oriented laterally with respect to the longitudinally extending rail channel length (in other words, perpendicular thereto and across its width). FIG. 15 also illustrates this embodiment (at the top) showing pin 52 positioned for insertion through opening 50 in the upright 20.

Figure 10B:
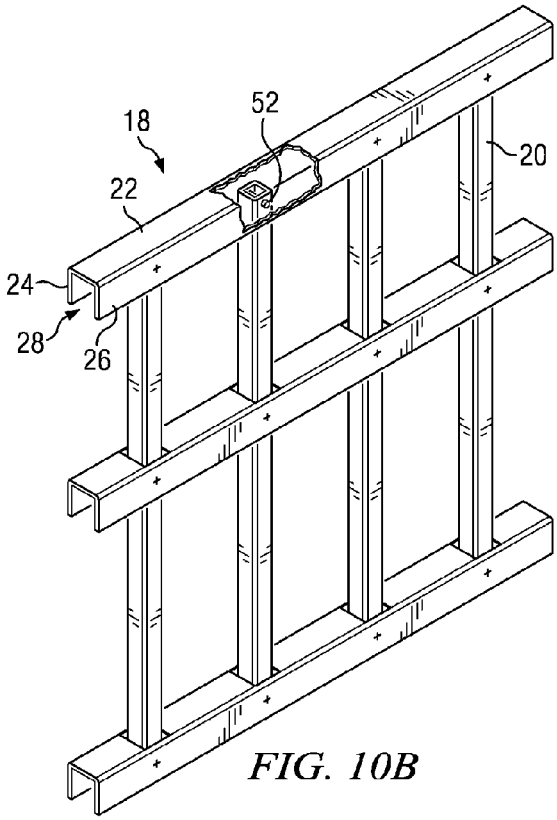
Figure 13B:
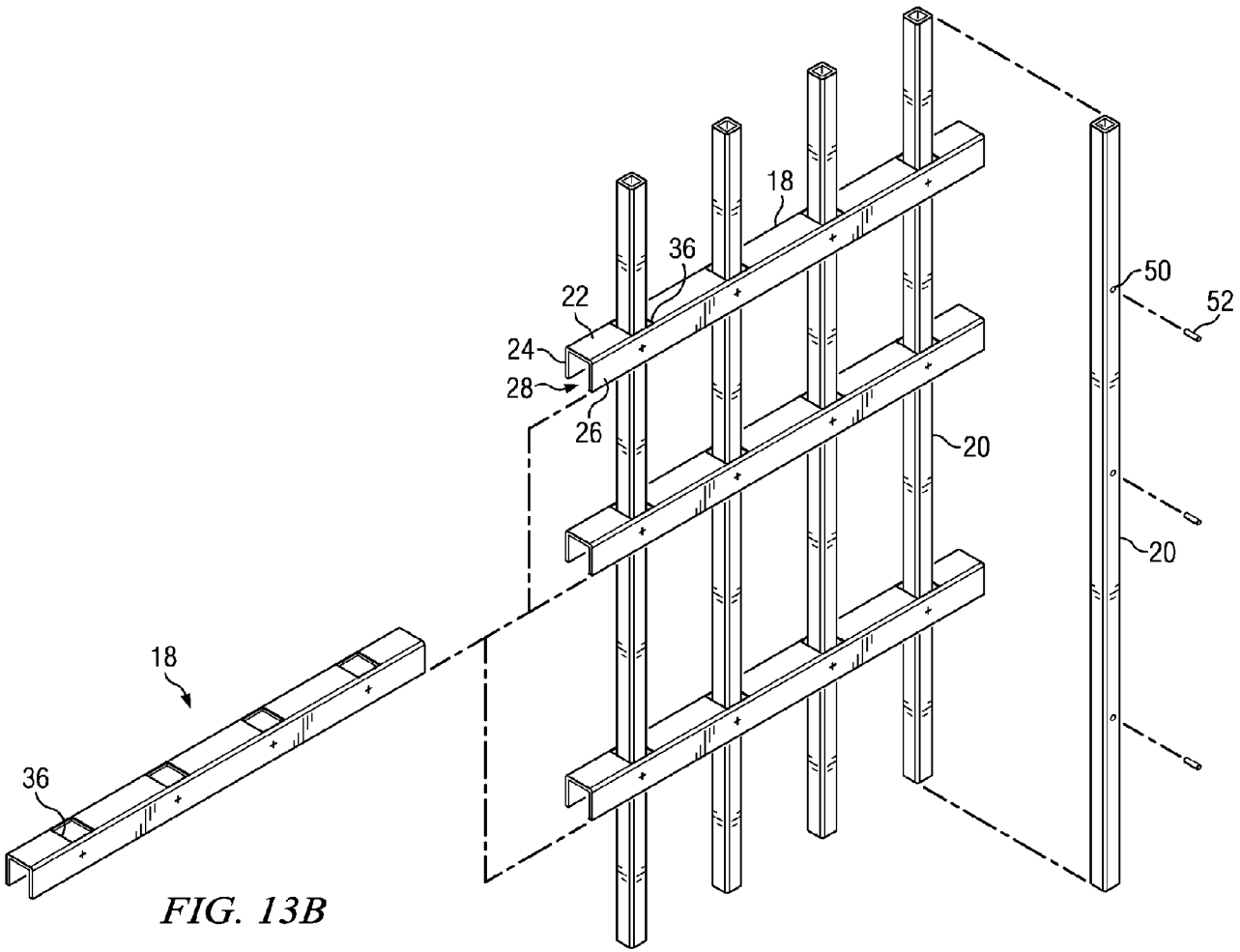

The location along the length of the members 20 of any included apertures 50 (and associated pins 52) is selected based on the type of barrier/fence being constructed. FIG. 4A shows aperture/pin location for use in an embodiment having a flat top and flat bottom panel as shown in FIGS. 1 and 2 (see, also, FIG. 10B). FIG. 4B shows aperture/pin location for use in an embodiment having an extended top and flat bottom panel as shown in FIG. 5 (see, also, FIG. 12). Aperture/pin location on the upright member 20 may further be selected (not explicitly shown) for use in an embodiment having a flat top and extended bottom panel as shown in FIG. 6. FIG. 4C shows aperture/pin location for use in an embodiment having an extended top and extended bottom panel as shown in FIG. 5 (see, also, FIGS. 11, 13B and 14). In connection with the embodiment of FIGS. 3D-3E (as shown on the left hand side of FIGS. 4A, 4B and 4C), each of the upright members 20 is preferably sized to receive the pin 52 with extensions on either end.

Figure 9B:
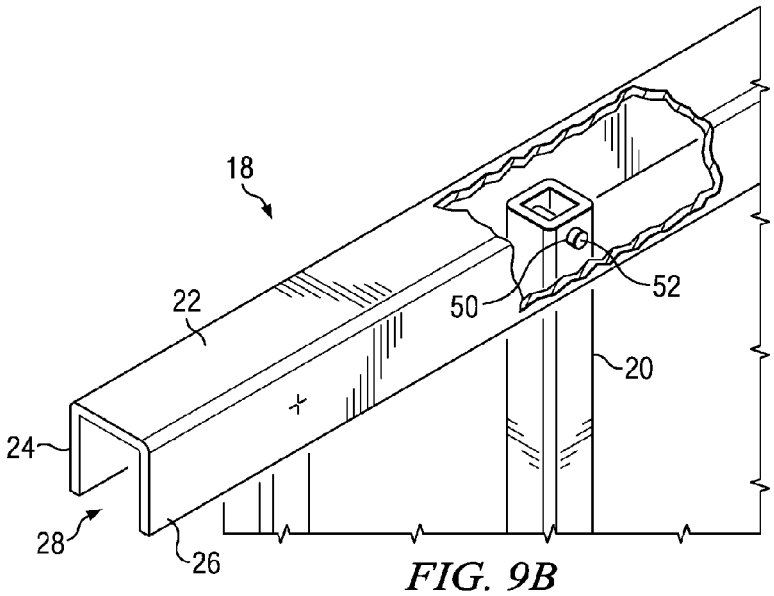

Reference is now made to FIG. 8B which shows an exemplary assembly of a panel (such as the panel used in the fence of FIGS. 1 and 2). Each panel includes three rails comprising one FIG. 3D rail and two FIG. 3E rails. The FIG. 3D rail forms a top rail of the panel, while the two FIG. 3E rails form a middle and bottom rail, respectively, of the panel. With respect to the two FIG. 3E rails, the upright members pass through rectangular openings 36 formed in the web 22 at the positions in the panel where upright members are desired. It will of course be understood that the opening 36 need not in all cases be rectangular, but instead may be oval-shaped especially for use in situations where the upright members have round or oval cross-sections. Each upright member is received within the rail channel 28 of each rail 18, and the rails are aligned with the location of the pins 52 such that each included pin extends between the pair of opposed side walls 24 and 26 which extend from the web 22. This is shown in greater detail in FIG. 9B. A projection (resistance) welding technique known to those skilled in the art is used to weld the ends of the pins 52 to the inside surfaces of the pair of opposed side walls 24 and 26. No direct welding of the upright member to the rail is made. This results in the formation of a pivot, formed by the pin 52 and holes 50, having a lateral orientation, at the intersection of each upright member to each rail which allows for rotation of the upright member to orientations which are not perpendicular to the rail. With the resistance projection welding technique, the welds used to assemble each panel 16 are formed internally within the rail channels 28. The exterior surfaces of the panel 16 accordingly do not display any of the visible blemishes and marks which are characteristic of other assembly methods, such as those involving other types of welding.

With reference once again to FIG. 1, each panel 16 may be supported from an adjacent pair of posts 12 by a plurality of brackets 40, each of which is located at an end of a rail and is mounted to the post 12. Each bracket 40 includes fastener openings (not shown) which may be aligned with corresponding fastener openings formed in each end of each rail 18. Alternatively, it will be understood that the rail may be directly fastened, without the use of brackets 40, such as for example using welding techniques, to the post. Alternative bracket designs known to those skilled in the art could be used.

When installed on horizontal terrain, as shown in FIG. 1, the rails 18 are disposed substantially horizontally and upright members substantially vertically. When installed on non-horizontal terrain, as shown in FIG. 2, the pivot provided through the pivot points using pins 52 or clips 130 and holes 50 allows the panel to be racked to a selected angle such that the rails 18 are disposed substantially parallel with the non-horizontal terrain while the upright members remain substantially vertical. The rectangular openings 36 are sized to permit the racking operation but provide a limit to the degree of racking allowed. The non-perpendicular angle of the racking for the panel is selected by the installer on site in accordance with the desired use and terrain conditions. The inner surface 146 of each flange 134 and 136 further restrains lateral movement of the upright members within the openings 36 and thus assists in preventing the edges of the openings from marring the outer surface of the upright member as the panel is racked. If desired, a step or detent could be stamped into each flange 134 and 136 to form a standoff in connection with controlling undesired lateral movement of the upright member after panel assembly.

Thus, the design is for both fencing and railing products that can be used in both flat and undulating terrain, deck railing and/or for stair railing. Unlike fencing and railing products made specifically for flat or undulating terrain, or stairs, the design of this panel allows it to be used in flat installation or racked for stair or undulating installations.

The design is based on a pin or shaft that is inserted into the picket(s) (vertical member) that is used for rotation of the pickets for rack-ability of the panel. The design is also based on the pin being supported by either a) a clip member which is welded to the inside of the panel's U-Channel shaped rail(s) (horizontal member) using projection or resistance type welding which will leave minimal if any external marks, or b) the welding of the through-extending pin at either end to the inside of the panel's U-Channel shaped rail(s) (horizontal member) using projection or resistance type welding which will leave minimal if any external marks. The fence and railing panel will be sufficiently stiff to make it easy for the installer to mount the panels without them racking, and will be mobile enough through the pivot to be able to easily adjust or rack them without exerting excessive force. The design also gives an esthetically better looking product by eliminating external fasteners commonly used to assemble panels.

The fence panels are made from one (1) or more horizontal members (Rails), one (1) or more vertical members (Pickets), and a plurality of clip members plus brackets and posts.

A second portion of the design is to change the rails (horizontal members) so there is no extra room in the hole 36 the picket goes through for enabling racking. This would give a fixed panel but advantageously use the same manufacturing techniques as the panel which is capable of being racked. This fixed panel could be used on projects that do not need the racking capability like a gate. It will of course be understood that other implementations for a non-racking product could be used, such as welding the picket (upright) to the inside of the channel.

The following provides a parts list for a three rail panel (such as shown in FIGS. 1 and 2):

1. Vertical Member (Picket): There are four (4) types of pickets. The difference between the pickets is the length and placement of the pins for the different type of panels: a) Flat Top, Extended Bottom; b) Extended Top, Extended Bottom; c) Extended Top, Flat Bottom; and d) Flat Top, Flat Bottom. Ornamentation may be added to the pickets if desired (see, for example, FIG. 14 which shows an added spear top).

2. Horizontal Member (Rail): There are two (2) types of Rails. The Top Rail is used on the Flat Top panel. The Through Rail is used for the Middle and/or Bottom Rail in all panels, and as the Top Rail in the Extended Top panel. Again, different cross-sectional shapes of the rails are supported, where the shape may be different depending on the uses and desired ornamentation.

3. Bracket: a number of possible designs may be used to accomplish some combination of all the possible mounting requirements as follows: a) Straight (no adjustment); b) Vertical Adjustment; c) Horizontal Adjustment; and d) Universal (Omni-Horizontal and Vertical Adjustment). Again, the use of brackets with respect to the panels is optional. A direct welded attachment of the panel rails to the posts is possible.

4. Post: The Posts are standard 2"×2" steel posts. Alternatively, the posts could be made of wood, composite, vinyl or aluminum, and may have any desired cross-sectional shape and size.

In connection with the embodiment of FIGS. 3A-3C, the panel further requires clip members each with flanges supporting opposed attachment pin. For Projection Welding (Resistance Welding) to work there needs to be a projection or tip to concentrate the energy from the welding machine. This is provided through the plurality of projections 144. These projections 144 comprise, for example, a rounded shape or a tapered shape formed through a stamping process.

In connection with the embodiment of FIGS. 3D-3E, the panel further requires attachment pins. For Projection Welding (Resistance Welding) to work there needs to be a projection or tip to concentrate the energy from the welding machine. The projection for the panels is accomplished at the ends of the Attachment Pins. Two of the methods used to form the projection on a pin or shaft include shaping either a rounded shape or a tapered shape at each end of the pin.

A description will now be provided as to the assembly of a fencing panel in accordance with the embodiment of FIGS. 3A-3C. The parts of the panel include: a) Channel used for top, middle, and bottom rail or horizontal member; b) Tubing (square, rectangular, or round) used as the picket(s) or vertical member(s); c) clip members with pin(s) used as rotational pivot point for pickets; d) Brackets used to secure the panel to the post; and e) Post used to hold the panel(s) in place.

Assembly of the panel proceeds as follows: 1) Raw material is manufactured into raw parts per parts drawings; 2) clip members are attached to pickets; 3) Rails are placed in manufacturing jig; 4) Pickets with clip members are pushed through rails until each picket is in place; 5) Once all Pickets are inserted in the rails the jig is slid into position on the digitally controlled welder feed table; 6) When the loaded jig is needed the welding feed will pull the jig into position and begin feeding it through the welding machine; 7) One at a time the welding heads for a given upright will extend and weld their respective clip members in position; 8) When welding is completed the jig will be indexed forward and the welding process will be repeated (this operation will continue until all the clip members in the panel have been welded); 9) When the panel has been welded the jig will be released from the welding feed and the next jig will be pulled into the welder; 10) The released panels will be removed from the jig and the jig cycled back to the front of the welding machine to be reloaded and processed.

A description will now be provided as to the assembly of a fencing panel in accordance with the embodiment of FIGS. 3D-3E. The parts of the panel include: a) Channel used for top, middle, and bottom rail or horizontal member; b) Tubing (square, rectangular, or round) used as the picket(s) or vertical member(s); c) Pin(s) used as rotational pivot point for pickets; d) Brackets used to secure the panel to the post; and e) Post used to hold the panel(s) in place.

Assembly of the panel proceeds as follows: 1) Raw material is manufactured into raw parts per parts drawings; 2) Pins are pressed into pickets; 3) Rails are placed in manufacturing jig; 4) Pickets are held at roughly 45° to parallel to the rails pushed through rails until each picket is in place (Holding the pickets at 45° allows the pins to go through the slots (openings 36) in the top of the rails); 5) Pickets are then rotated until properly seated in the rails; 6) Once all Pickets are inserted in the rails the jig is slid into position on the digitally controlled welder feed table; 7) When the loaded jig is needed the welding feed will pull the jig into position and begin feeding it through the welding machine; 8) One at a time the three (3) welding heads will extend and weld their respective pin in position (When a weld is completed the next welding head will extend and weld its pin); 9) When all three (3) welding heads have completed the jig will be indexed forward and the welding process will be repeated (This operation will continue until all the pins in the panel have been welded); 10) When the panel has been welded the jig will be released from the welding feed and the next jig will be pulled into the welder; 11) The released panels will be removed from the jig and the jig cycled back to the front of the welding machine to be reloaded and processed.

Some exemplary dimensions are provided for the panels: 1) for a Flat top, Extended bottom panel, 48 inches high, 94 inches long; 2) for a Flat top, Extended bottom panel, 60 inches high, 94 inches long; 3) for an Extended top, Extended bottom panel, 60 inches high, 94 inches long; 4) for an Extended top, Extended bottom panel, 72 inches high, 94 inches long; 5) for a Pressed Spear Extended top, Extended bottom panel, 48 inches high, 94 inches long; 6) for a Pressed Spear Extended top, Extended bottom panel, 72 inches high, 94 inches long; and 7) for a Flat top, Flat bottom panel, 54 inches high, 94 inches long.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A barrier formed from an elongate rail and a plurality of vertical upright members, wherein the elongate rail includes a web and a pair of opposed side walls which extend from the web to define a rail channel, wherein each upright member includes an aperture formed therein, and further including an individual clip associated with each one of the plurality of vertical upright members, each clip including a flange, wherein a pin extends from the flange of each clip, and wherein the pin is inserted into the aperture of the associated upright member, wherein each upright member, with its associated clip, is at least partially situated within the rail channel, and the clip is welded to an inside surface of the rail channel, and wherein each individual clip comprises a pair of opposing flexible flanges supporting an opposed pair of spaced apart pivot pins, the opposed pivot pins for insertion into opposed apertures formed in the upright member.

2. The barrier of claim 1 wherein resistance type welding is used so as to minimize a presence of markings on the outer surface of the rail channel.

3. The barrier of claim 1 wherein the pin and aperture form a pivot which supports movement of the at least one vertical upright member relative to the at least one elongate rail so as to enable the barrier to be racked.

4. The barrier of claim 3 wherein the aperture has an inner diameter slightly larger than an outer diameter of the pin.

5. The barrier of claim 1 wherein the upright member is not welded directly to the rail.

6. The barrier of claim 1 wherein the web further includes openings through which upright members extend, the clip being welded to the inside surface of the rail channel adjacent to the opening.

7. The barrier of claim 1 wherein the opposing flexible flanges reception of the upright member therebetween with insertion of the opposed pivot pins into the opposed apertures formed in the received upright member.

8. A barrier formed from at least one elongate rail and at least one vertical upright member, wherein the rail includes a web and a pair of opposed side walls which extend from the web to define a rail channel, wherein the upright member includes a hole formed there through, and wherein a pin is inserted through the hole in the upright member, wherein the upright member, with the pin, is at least partially situated within the rail channel, and opposed end surfaces of the pin are welded to inside surfaces of the opposed side walls of the rail channel without the pin passing through an aperture in the side wall, the welded pin and hole in the upright member configured to permit pivoting of the upright member relative to the rail.

9. The barrier of claim 8 wherein resistance type welding is used so as to minimize a presence of markings on the outer surface of the opposed side walls of the rail channel.

10. The barrier of claim 8 wherein the pin and hole form a pivot which supports movement of the at least one vertical upright member relative to the at least one elongate rail so as to enable the barrier to be racked.

11. The barrier of claim 10 wherein the hole has an inner diameter slightly larger than an outer diameter of the pin.

12. The barrier of claim 8 wherein the upright member is not welded directly to the rail.

13. The barrier of claim 8 wherein the web further includes openings through which upright members extend.

* * * * *

UNITED STATES PATENT AND TRADEMARK OFFICE

CERTIFICATE OF CORRECTION

PATENT NO. : 8,899,555 B2
APPLICATION NO. : 12/204607
DATED : December 2, 2014
INVENTOR(S) : Matthew Carlyle Sherstad It is certified that error appears in the above-identified patent and that said Letters Patent is hereby corrected as shown below:

In the Claims:

At column 10, claim number 7, line number 56, after "flexible flanges" add:

-- are configured to be laterally flexed outward to permit --

Signed and Sealed this
Tenth Day of March, 2015

Michelle K. Lee

Michelle K. Lee
*Deputy Director of the United States Patent and Trademark Office*